US008926135B2

(12) United States Patent
Zaderej et al.

(10) Patent No.: US 8,926,135 B2
(45) Date of Patent: Jan. 6, 2015

(54) HOLDER ASSEMBLY

(75) Inventors: Victor Zaderej, St. Charles, IL (US); Daniel B. McGowan, Naperville, IL (US); Daniel G. Achammer, Warrenville, IL (US)

(73) Assignee: Molex Incorporated, Lisle, IL (US)

( * ) Notice: Subject to any disclaimer, the term of this patent is extended or adjusted under 35 U.S.C. 154(b) by 123 days.

(21) Appl. No.: 13/513,802

(22) PCT Filed: Jan. 13, 2011

(86) PCT No.: PCT/US2011/021132

§ 371 (c)(1), (2), (4) Date: Dec. 19, 2012

(87) PCT Pub. No.: WO2011/088212

PCT Pub. Date: Jul. 21, 2011

(65) Prior Publication Data

US 2013/0084748 A1 Apr. 4, 2013

Related U.S. Application Data

(60) Provisional application No. 61/294,746, filed on Jan. 13, 2010, provisional application No. 61/295,550, filed on Jan. 15, 2010, provisional application No. 61/301,828, filed on Feb. 5, 2010, provisional application No. 61/366,260, filed on Jul. 21, 2010.

(51) Int. Cl.

| | |
|---|---|
| ***H01R 4/24*** | (2006.01) |
| ***H01R 33/945*** | (2006.01) |
| ***H01R 4/48*** | (2006.01) |
| ***F21V 19/00*** | (2006.01) |
| ***F21K 99/00*** | (2010.01) |
| ***H01R 13/66*** | (2006.01) |
| ***H01R 13/717*** | (2006.01) |
| *F21Y 101/02* | (2006.01) |

(52) U.S. Cl.

CPC ..... *H01R 13/7175* (2013.01); *H01R 33/945* (2013.01); *H01R 4/4818* (2013.01); *F21V 19/003* (2013.01); *F21V 19/0035* (2013.01); *F21Y 2101/02* (2013.01); *F21K 9/00* (2013.01); *H01R 13/665* (2013.01)

USPC ..... 362/249.05; 362/646; 439/56; 439/404

(58) Field of Classification Search

USPC ..... 362/249.05, 646; 439/56, 699.2, 404, 439/405

See application file for complete search history.

(56) References Cited

U.S. PATENT DOCUMENTS 4,133,595 A 1/1979 Pritulsky
4,547,840 A * 10/1985 Tinder ..... 362/646

(Continued)

FOREIGN PATENT DOCUMENTS

CN 201209837 Y 3/2009
JP 54-115585 U 8/1979

(Continued)

*Primary Examiner* — Gary Paumen
(74) *Attorney, Agent, or Firm* — Stephen L. Sheldon

(57) ABSTRACT

A holder assembly includes a cover and a frame that together can support a first and second terminal that can each include a two-way wire trap feature. The terminals can be configured with contacts that are configured to engage pads on a corresponding LED array. One or both of the terminals can also omit the contact and can be mounted so as to be in electrical contact with traces provided on the frame and the traces can be electrically connected to the anode and cathode of the LED array. The frame can further support circuitry that is configured to convert AC to DC.

21 Claims, 20 Drawing Sheets

(56) References Cited

U.S. PATENT DOCUMENTS

| | | | | |
|---|---|---|---|---|
| 6,773,296 | B2 * | 8/2004 | Kihira et al. | 439/445 |
| 7,201,601 | B2 * | 4/2007 | Lappohn | 439/404 |
| 7,828,557 | B2 | 11/2010 | Vogt et al. | |
| 2008/0037258 | A1 | 2/2008 | Lin | |
| 2008/0089072 | A1 | 4/2008 | Kim et al. | |
| 2008/0170396 | A1 | 7/2008 | Yuan et al. | |
| 2008/0266869 | A1 | 10/2008 | Tai et al. | |
| 2009/0207617 | A1 | 8/2009 | Merchant et al. | |

FOREIGN PATENT DOCUMENTS

| | | | |
|---|---|---|---|
| JP | 57-122688 | U | 7/1982 |
| JP | 58-130387 | U | 9/1983 |
| JP | 62-005490 | U | 1/1987 |
| JP | 2003-068111 | | 3/2003 |
| JP | 2003-068130 | | 3/2003 |

* cited by examiner

HOLDER ASSEMBLY

RELATED CASES

This application is a national phase of PCT application No. PCT/US11/21132, filed Jan. 13, 2011, which is incorporated by reference and which claims priority of U.S. Provisional Application No. 61/294,746, filed Jan. 13, 2010, U.S. Provisional Application No. 61/295,550, filed Jan. 15, 2010, U.S. Provisional Application No. 61/301,828, filed Feb. 5, 2010, and U.S. Provisional Application No. 61/366,260, filed Jul. 21, 2010, all of which are incorporated herein by reference in their entirety.

BACKGROUND OF THE INVENTION

1. Field of the Invention

The present invention relates to the field of illumination with a light emitting diode (LED), more specifically to arrays of LEDs.

2. Description of Related Art

LEDs have been developed to provide illumination. Compared with other technologies, LEDs have potential benefits such as providing higher efficiencies and very long life (50,000 hours or more). Initial designs for LEDs tended to focus on emitters, which tend to include a single die (typically a blue pump) mounted on a holder and with a phosphor encapsulated above the die. LEDs, however, tend to be more efficient at lower current levels and thus it is difficult to obtain high lumen output from a single emitter while still obtaining a desired level of efficiency. Therefore, emitters are not well suited to meet the desire of providing 600-800 lumens (or more) of light typically provided by conventional light sources. While a number of emitters used together can provide the desired level of light output, the use of a number of discrete light sources is problematic from a quality of light standpoint.

To address this issue, LED arrays have been developed as a cost effective method to provide sufficient illumination. An LED array typically consists on a number of LED die positioned on a substrate in some pattern (e.g., in series or parallel). An anode and cathode are coupled to the LED die so that current can be delivered to the LEDs. Such an LED array is available from BRIDGELUX. One issue that exists, however, is how to mount the LED array in a larger housing that can be used to provide power to the LED and can also support necessary optics and/or thermal management. This process can be further complicated if the LED array is provided on a thermally conductive substrate as it becomes more difficult to solder a wire to the anode and cathode. Therefore, certain individuals would appreciate an improved system for supporting and/or mounting an LED array.

BRIEF SUMMARY OF THE INVENTION

A holder assembly includes a cover and a frame that is provided with a first and second terminal suitable for receiving a wire. In an embodiment the terminals can be two-way wire traps. If desired, the terminals can further include a contact configured to directly engage an anode and cathode on an LED array. One or both of the terminals can also omit the contact and can be mounted so as to be in electrical contact with traces provided on the frame and the traces can be electrically connected to the anode and cathode of the LED array. The frame can further support circuitry that is configured to convert AC power to DC power.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

Figure 1:
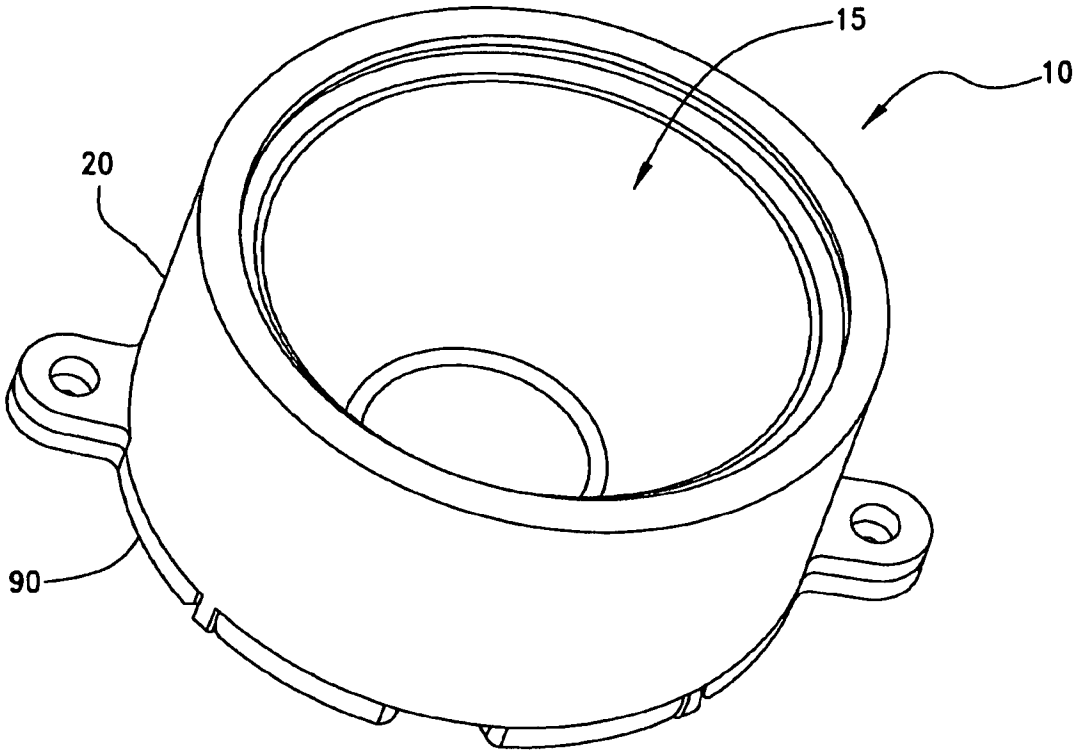
FIG. 1 illustrates a perspective view of an embodiment of a holder assembly.
Figure 2:
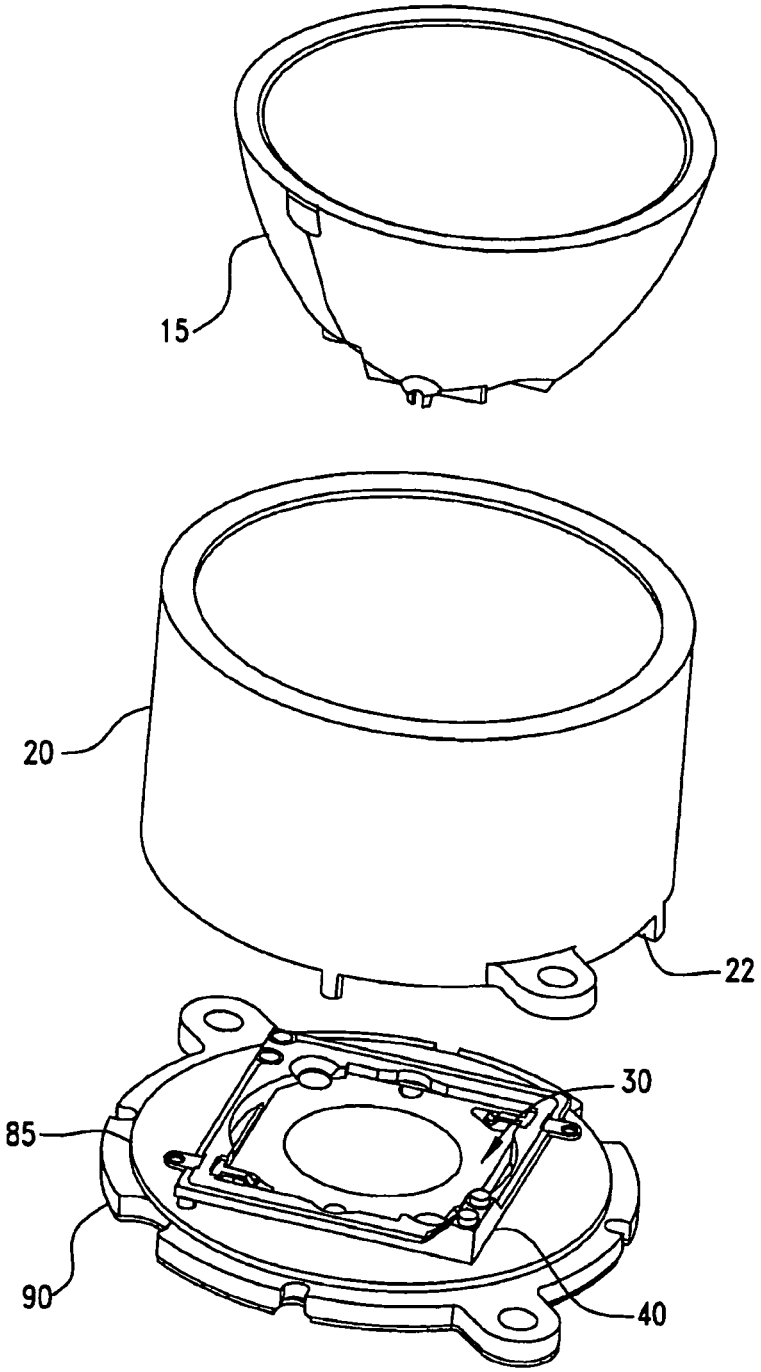
FIG. 2 illustrates a perspective exploded view of the holder assembly depicted in FIG. 1.
Figure 3:
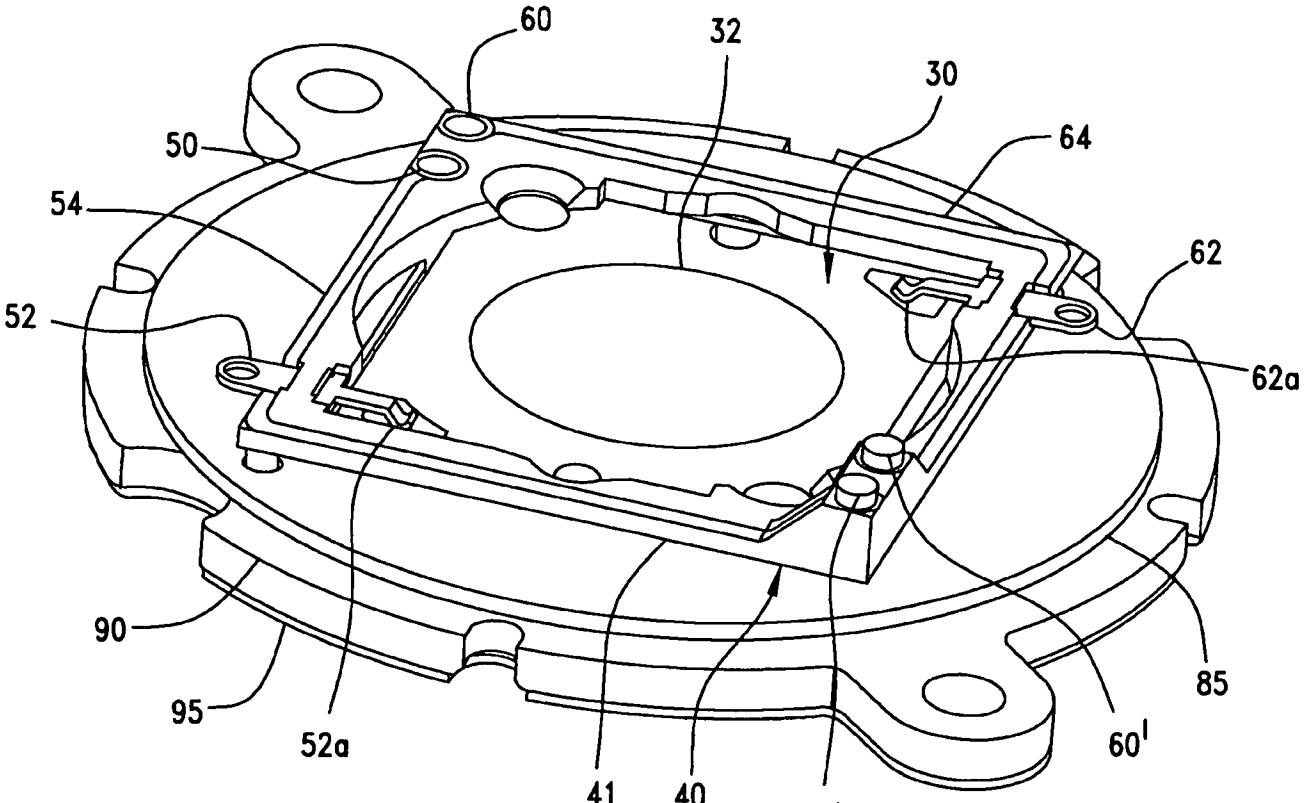
FIG. 3 illustrates a perspective view of an embodiment of a frame and LED array suitable for use in the embodiment depicted in FIG. 1.
Figure 4:
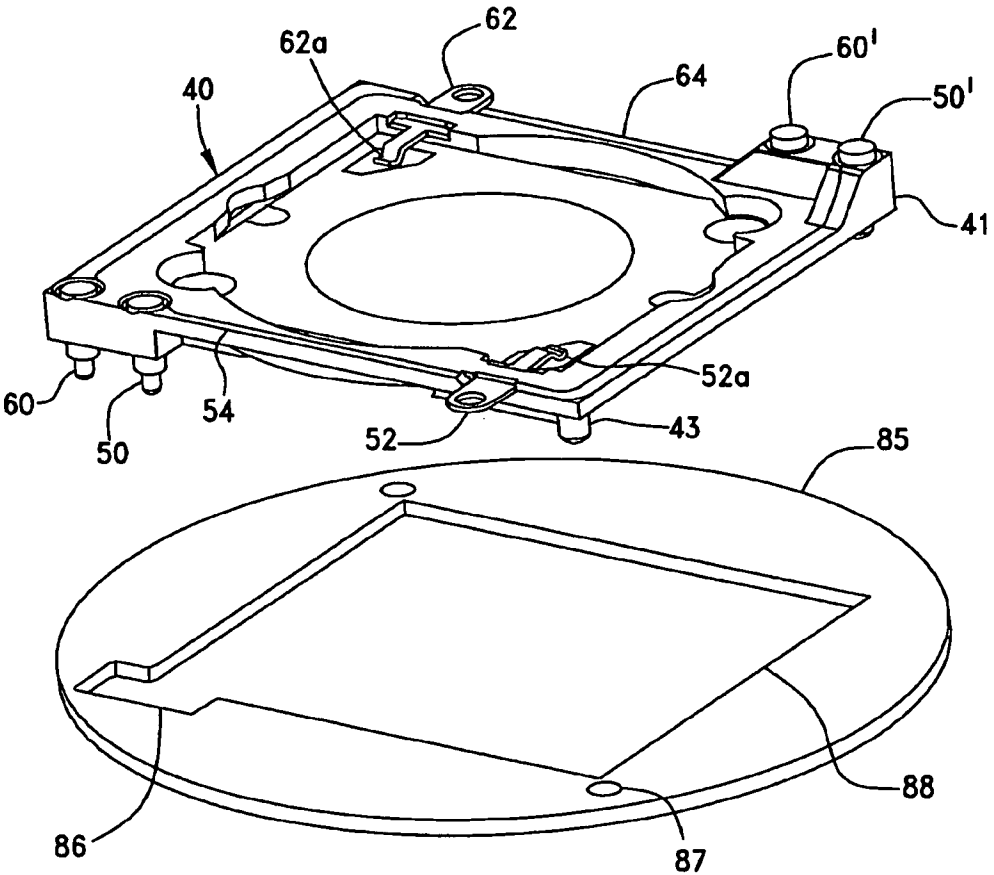
FIG. 4 illustrates a partially exploded and simplified view of the frame depicted in FIG. 3.
Figure 5:
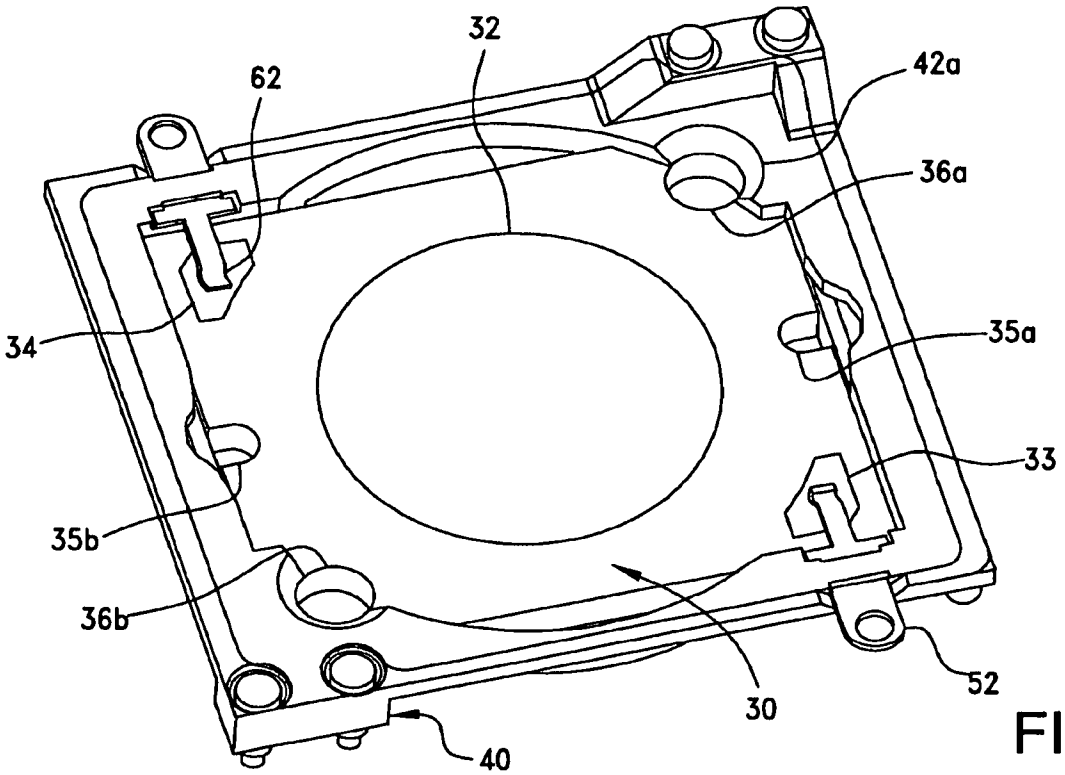
FIG. 5 illustrates a simplified perspective view of the frame and LED array depicted in FIG. 3.
Figure 6:
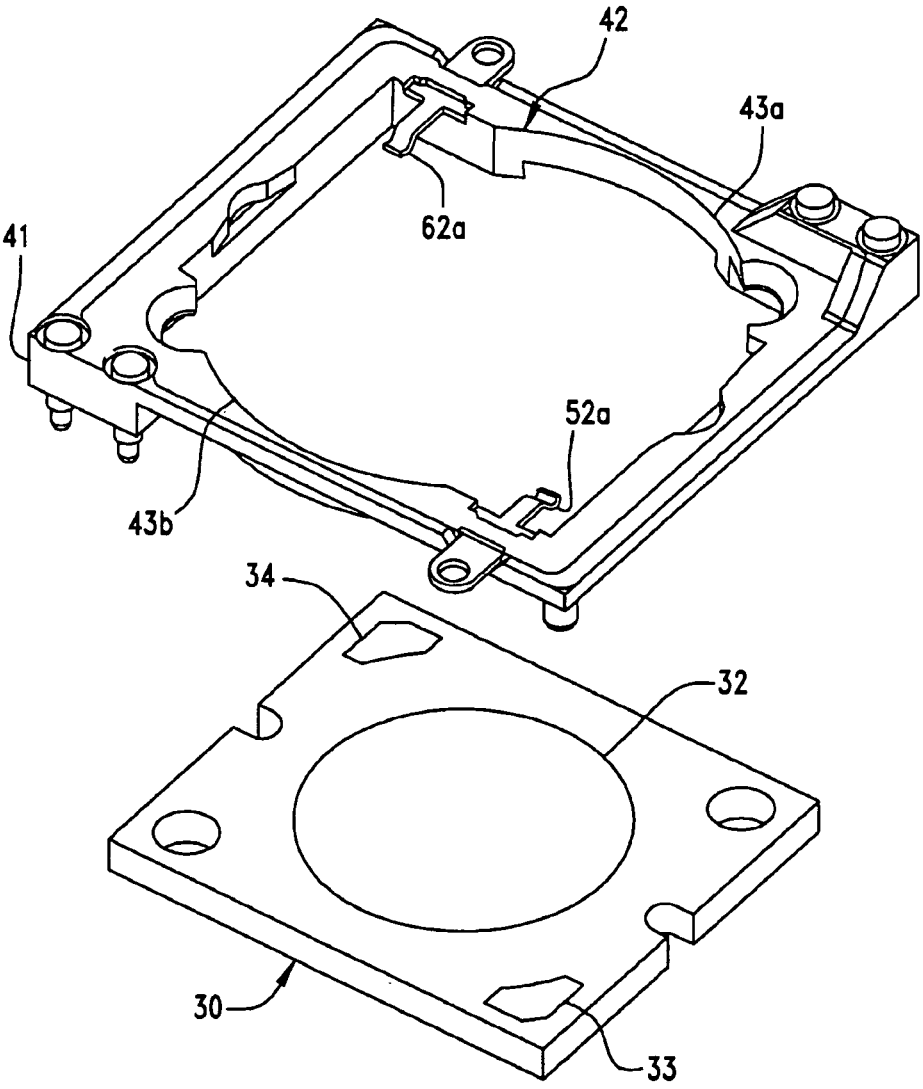
FIG. 6 illustrates a partially exploded perspective view of the frame and LED array depicted in FIG. 5.
Figure 7:
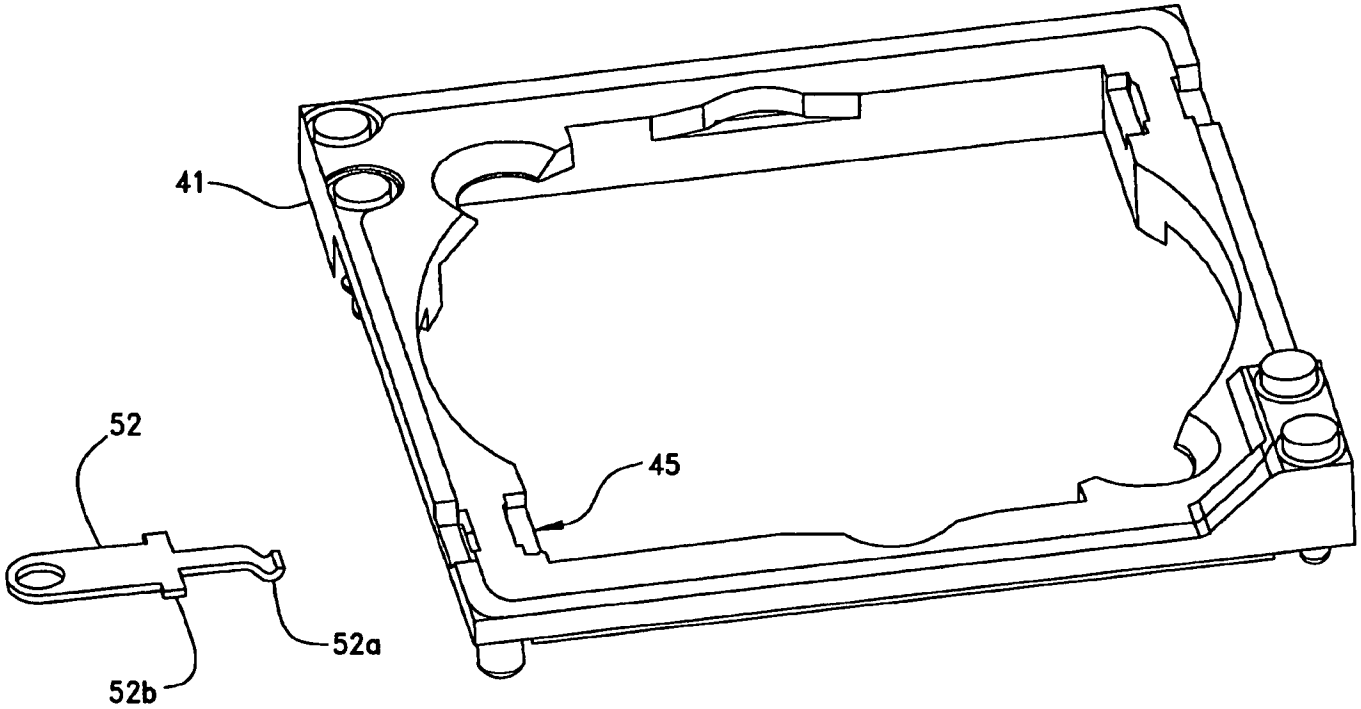
FIG. 7 illustrates a partially exploded and simplified view of an embodiment of a frame suitable for use with the embodiment depicted in FIG. 6.
Figure 8:
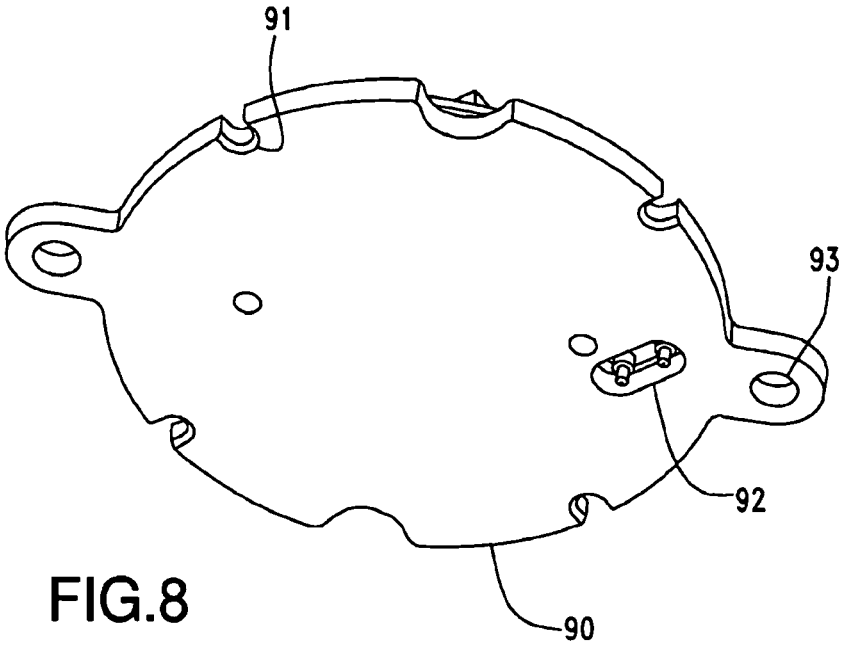
FIG. 8 illustrates another perspective view of an embodiment depicted in FIG. 3.
Figure 9:
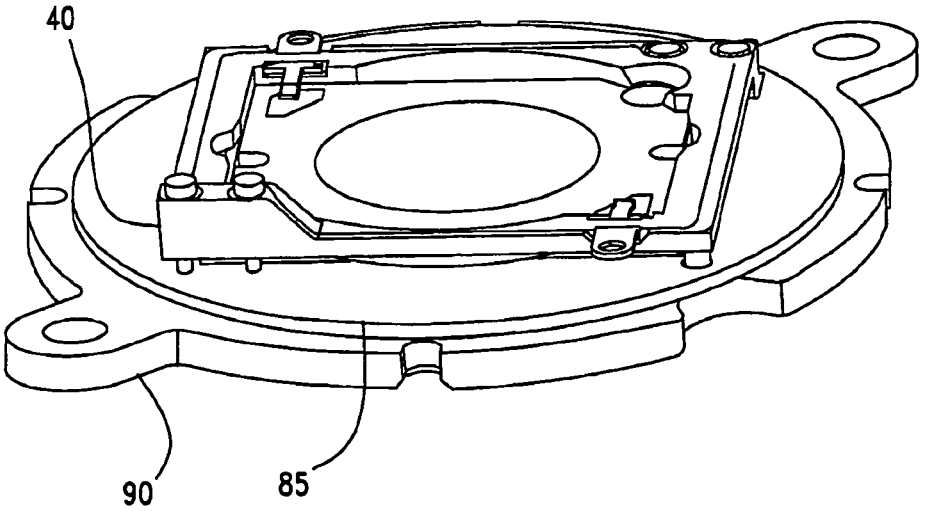
FIG. 9 illustrates another perspective view of the embodiment depicted in FIG. 3.
Figure 10:
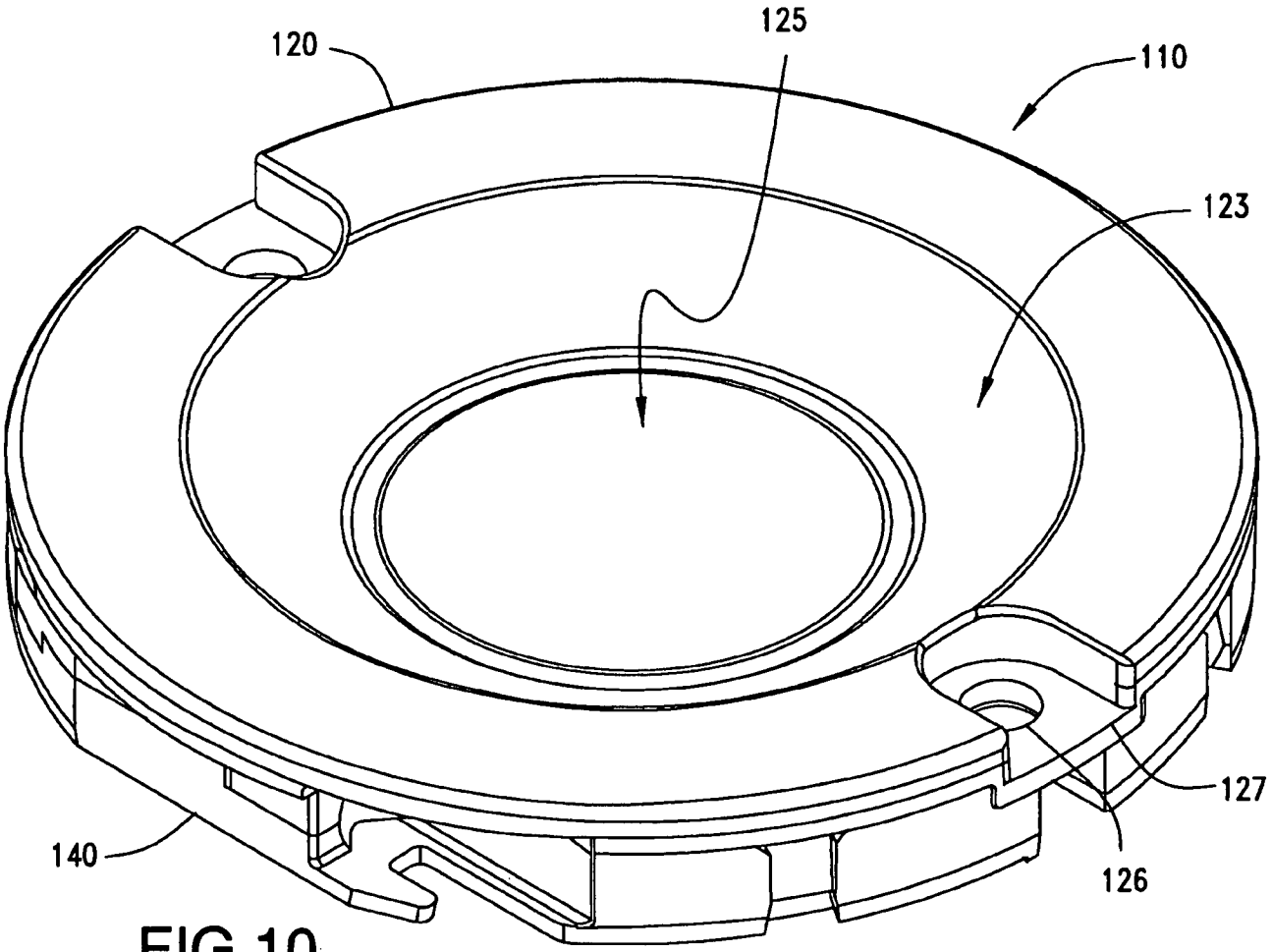
FIG. 10 illustrates a perspective view of another embodiment of a holder assembly.
Figure 11:
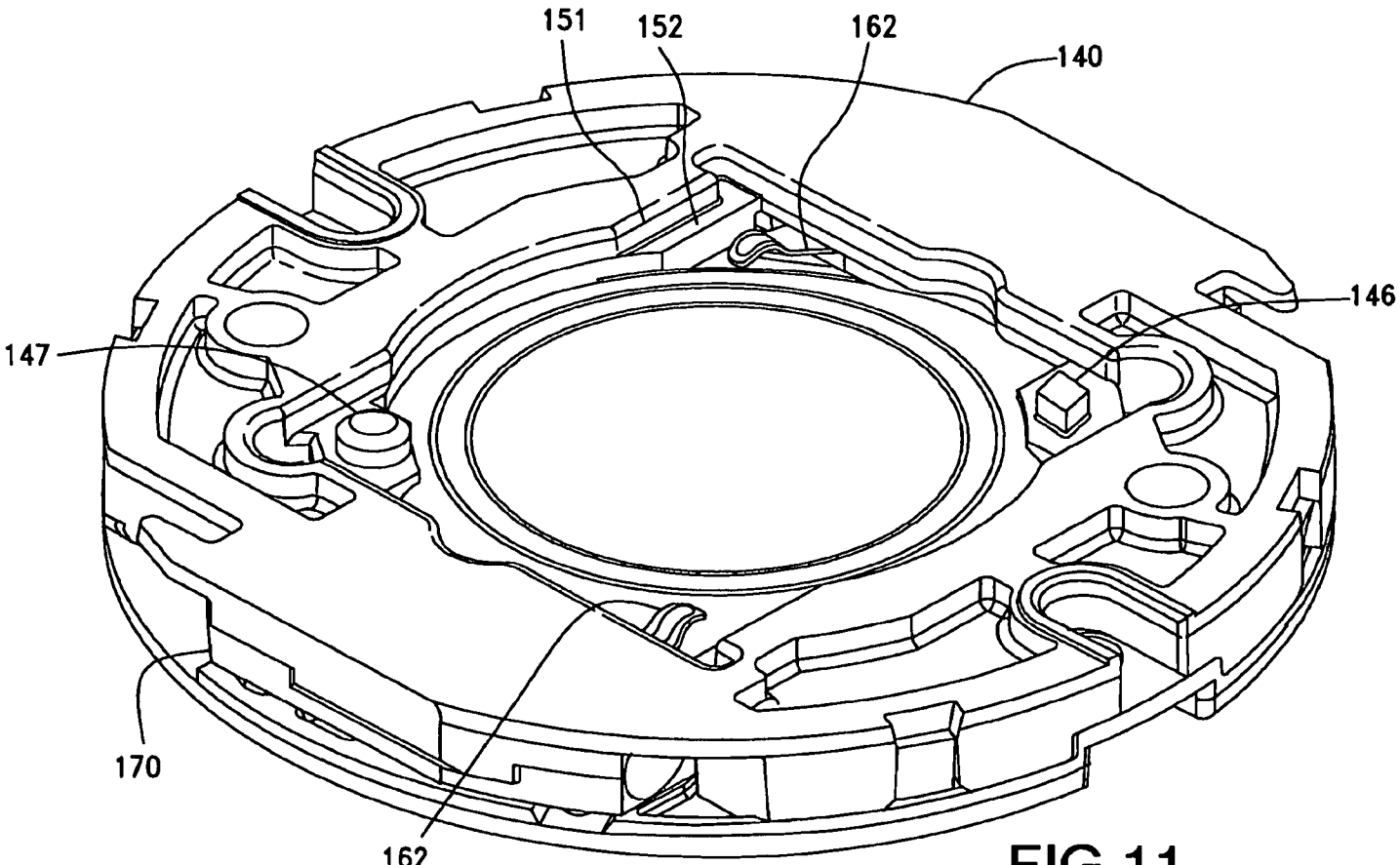
FIG. 11 illustrates another perspective view of the embodiment depicted in FIG. 10.
Figure 12:
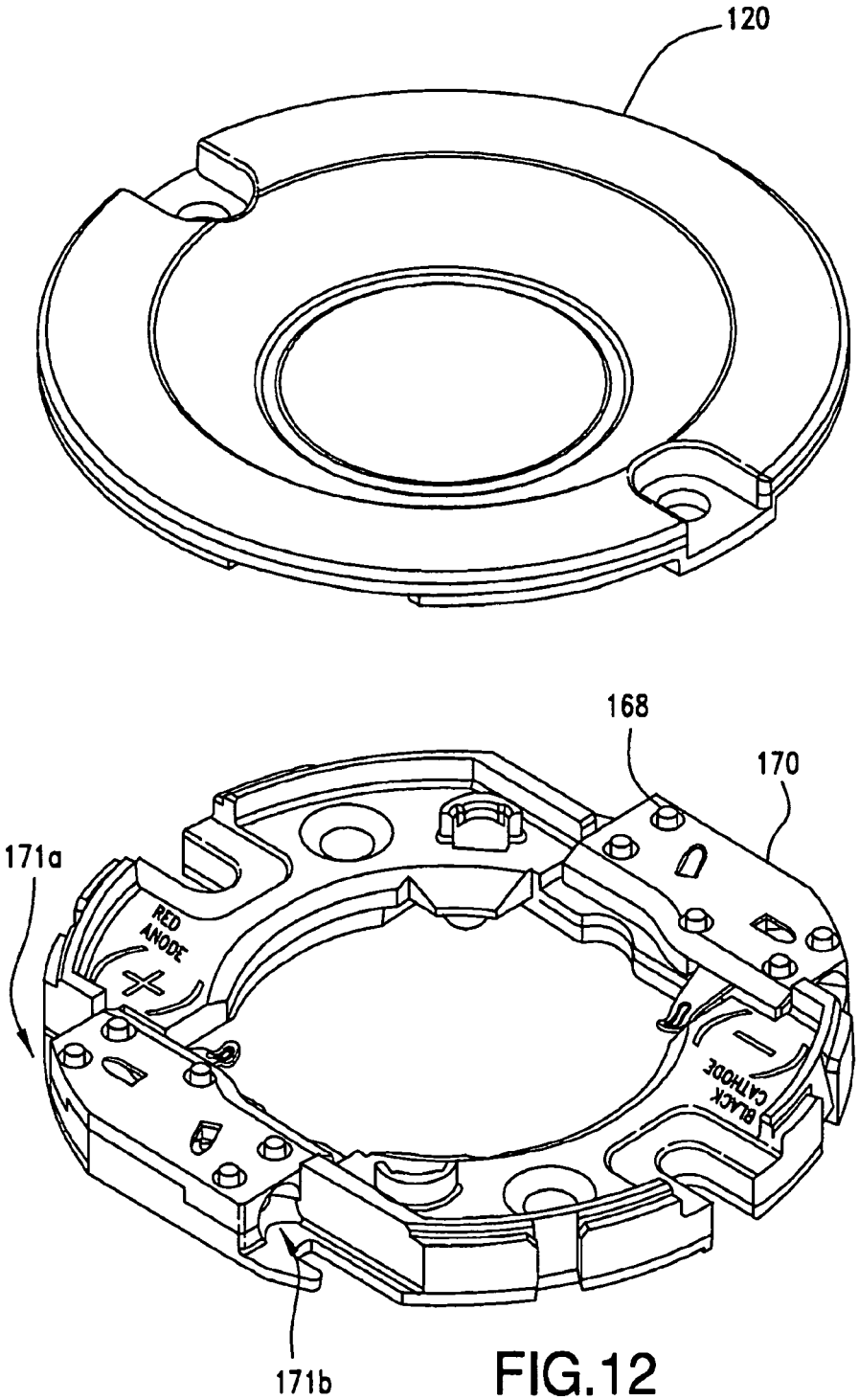
FIG. 12 illustrates a partially exploded perspective view of the embodiment depicted in FIG. 10.
Figure 13:
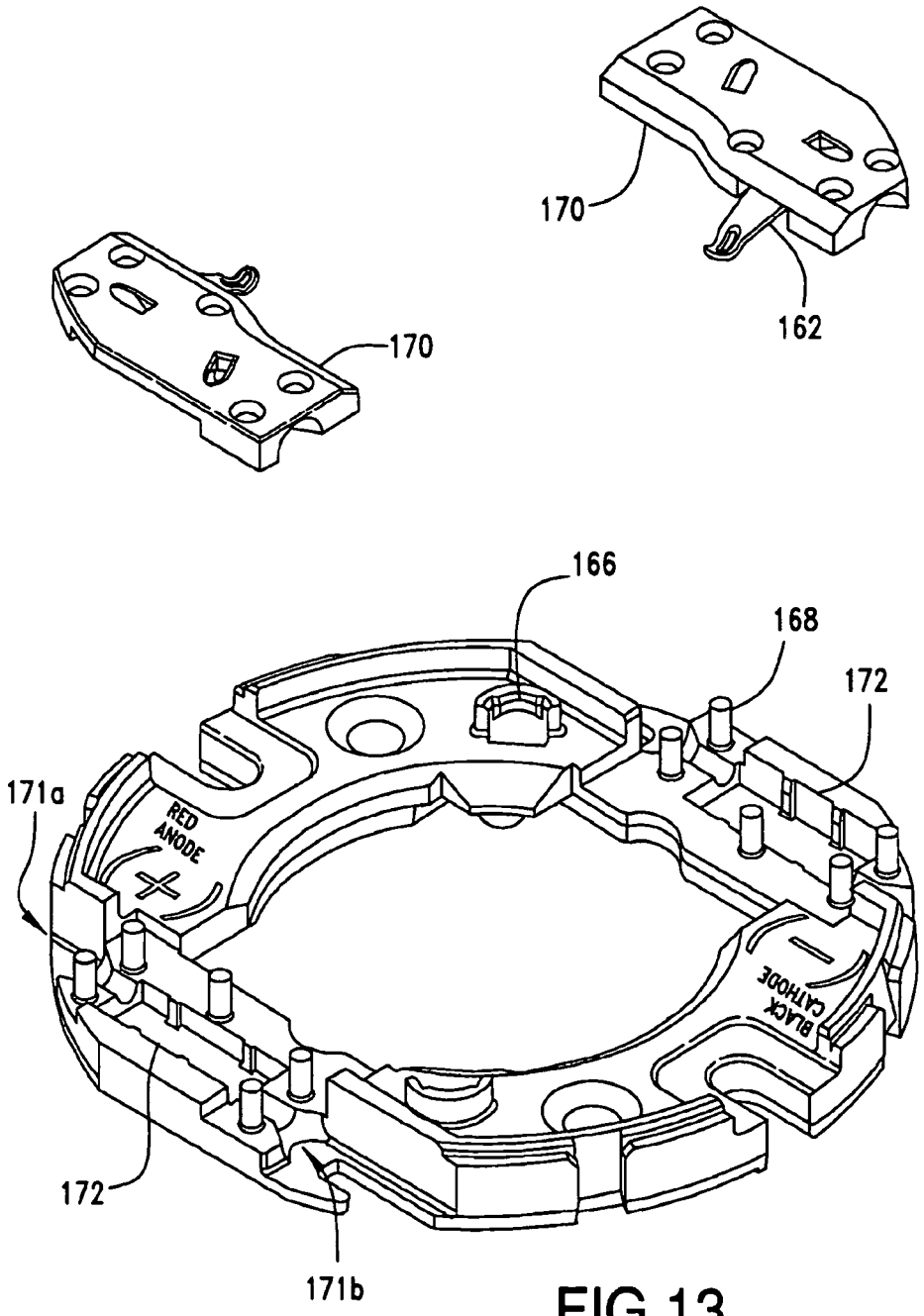
FIG. 13 illustrates a simplified partially exploded perspective view of the embodiment depicted in FIG. 12.
Figure 14:
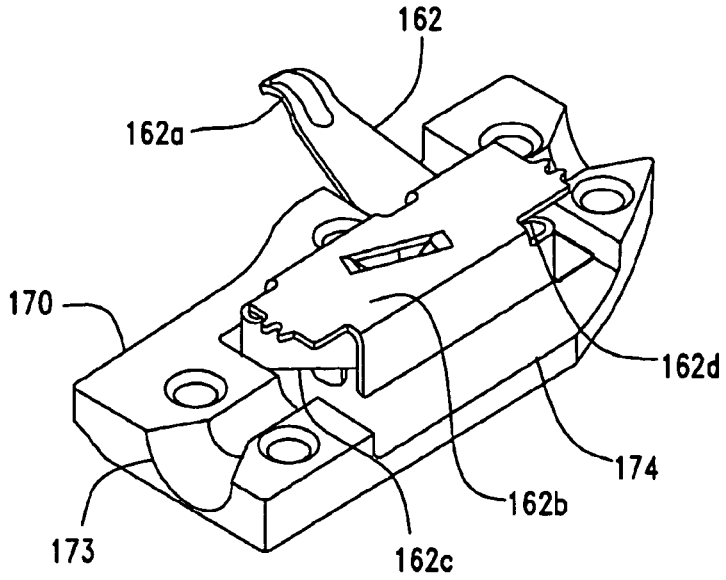
FIG. 14 illustrates a perspective view of a terminal and plate suitable for use with a frame depicted in FIG. 13.
Figure 15:
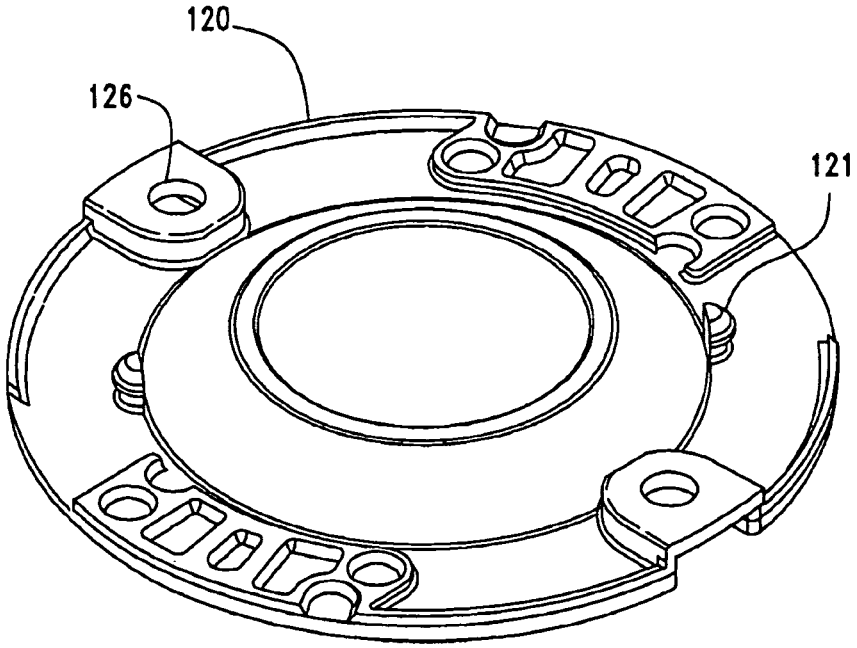
FIG. 15 illustrates a perspective view of an embodiment of a cover suitable for use in the holder assembly depicted in FIG. 10.
Figure 16:
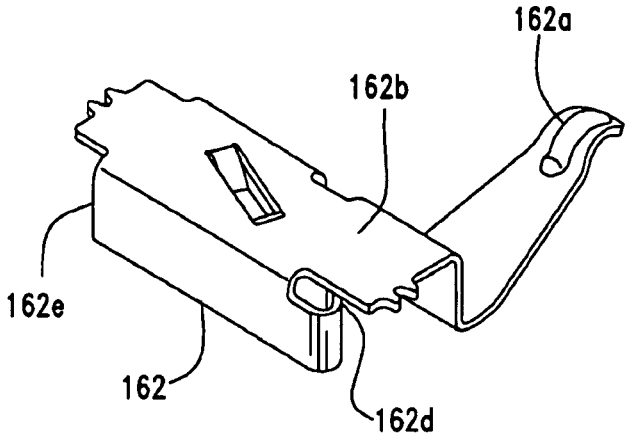
FIG. 16 illustrates a perspective view of an embodiment of a terminal.
Figure 17:
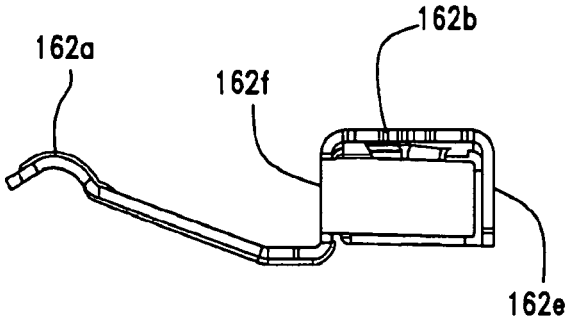
FIG. 17 illustrates an elevated side view of the terminal depicted in FIG. 16.
Figure 18:
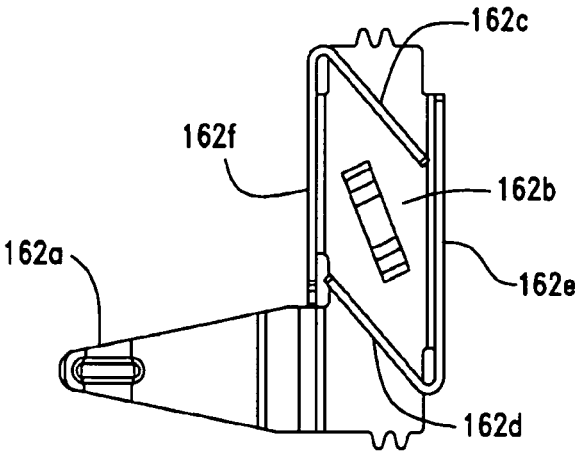
FIG. 18 illustrates an elevated bottom view of the terminal depicted in FIG. 16.
Figure 19:
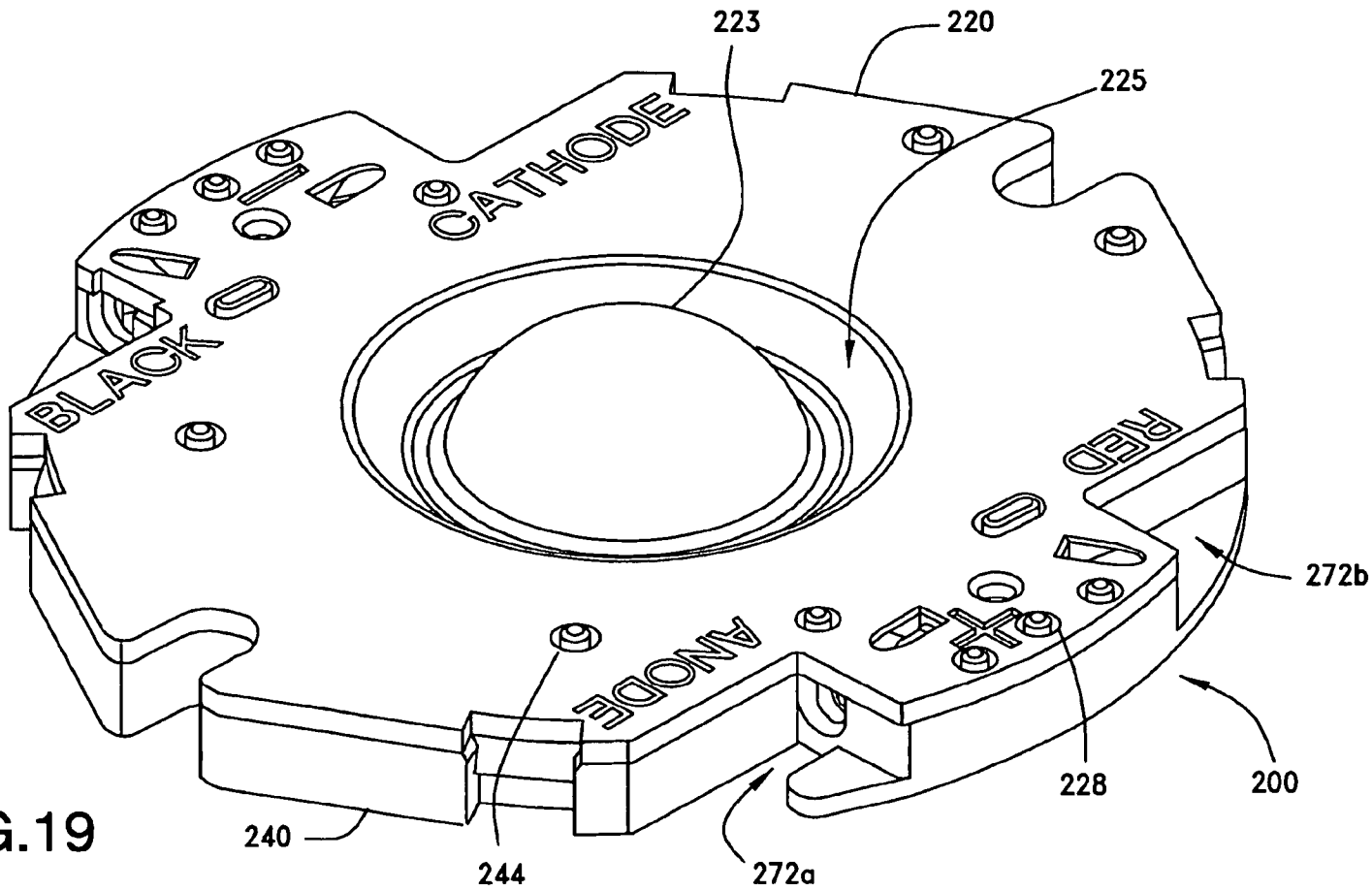
FIG. 19 illustrates a perspective view of another embodiment of a holder assembly.
Figure 20:
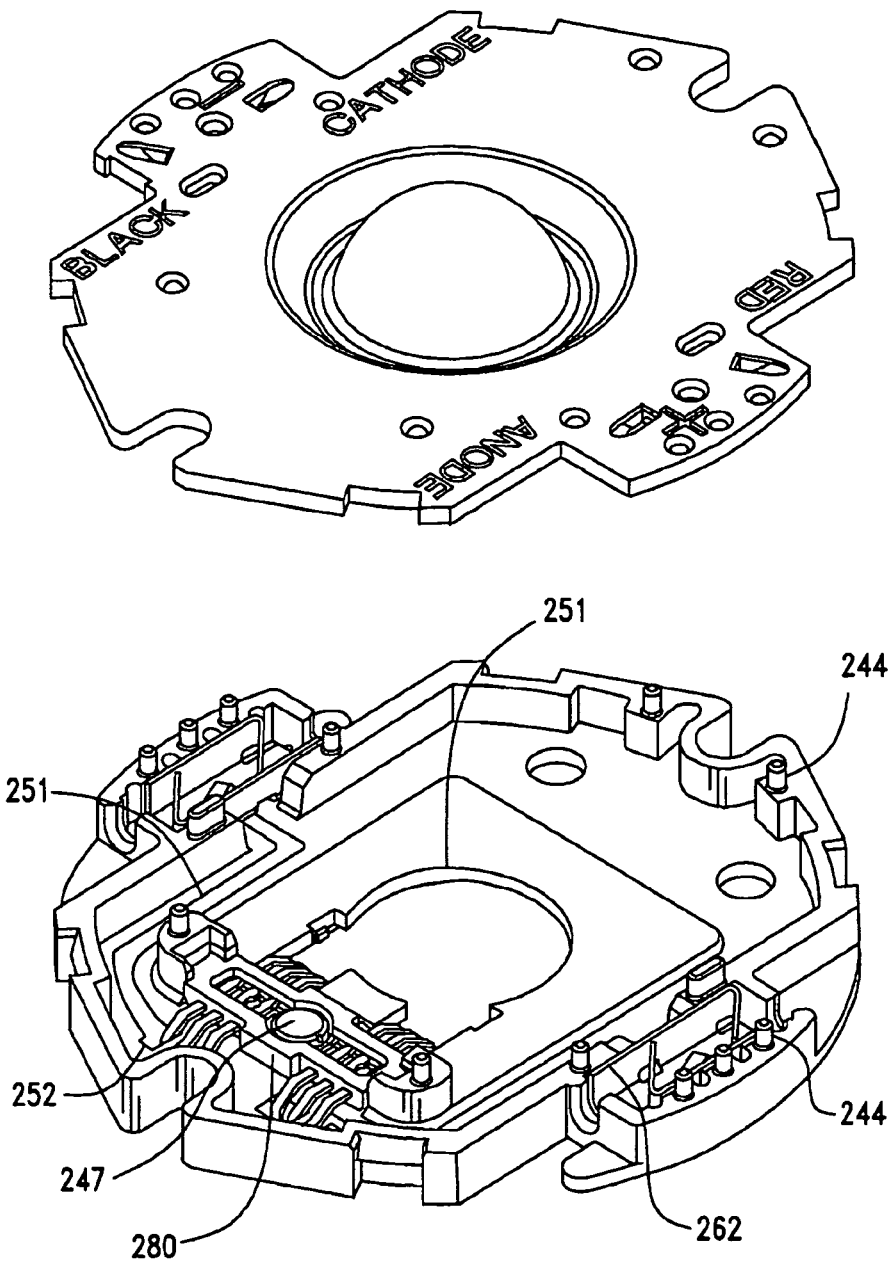
FIG. 20 illustrates an exploded perspective view of the holder assembly depicted in FIG. 19.
Figure 21:
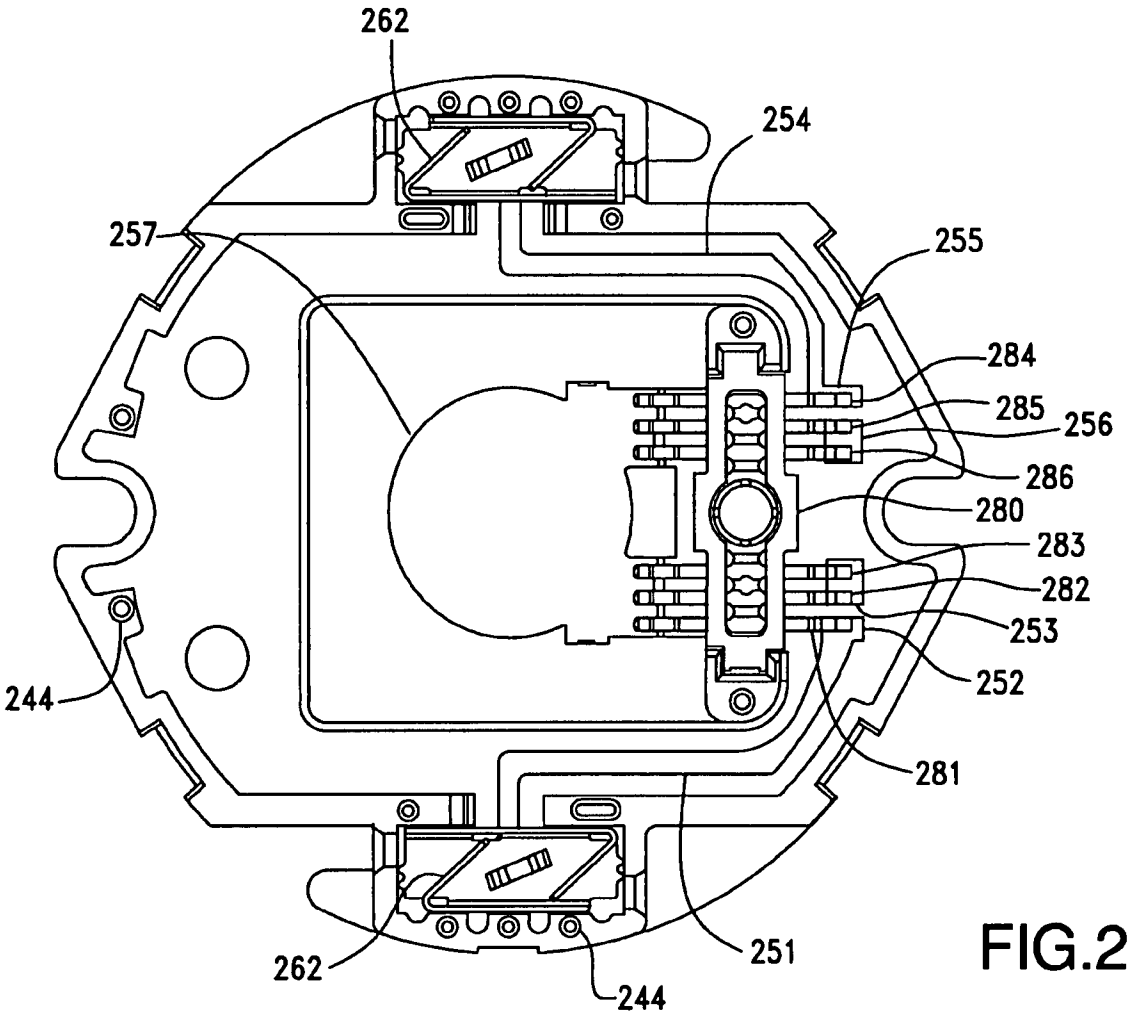
FIG. 21 illustrates an elevated plan view of a frame depicted in FIG. 20.
Figure 22:
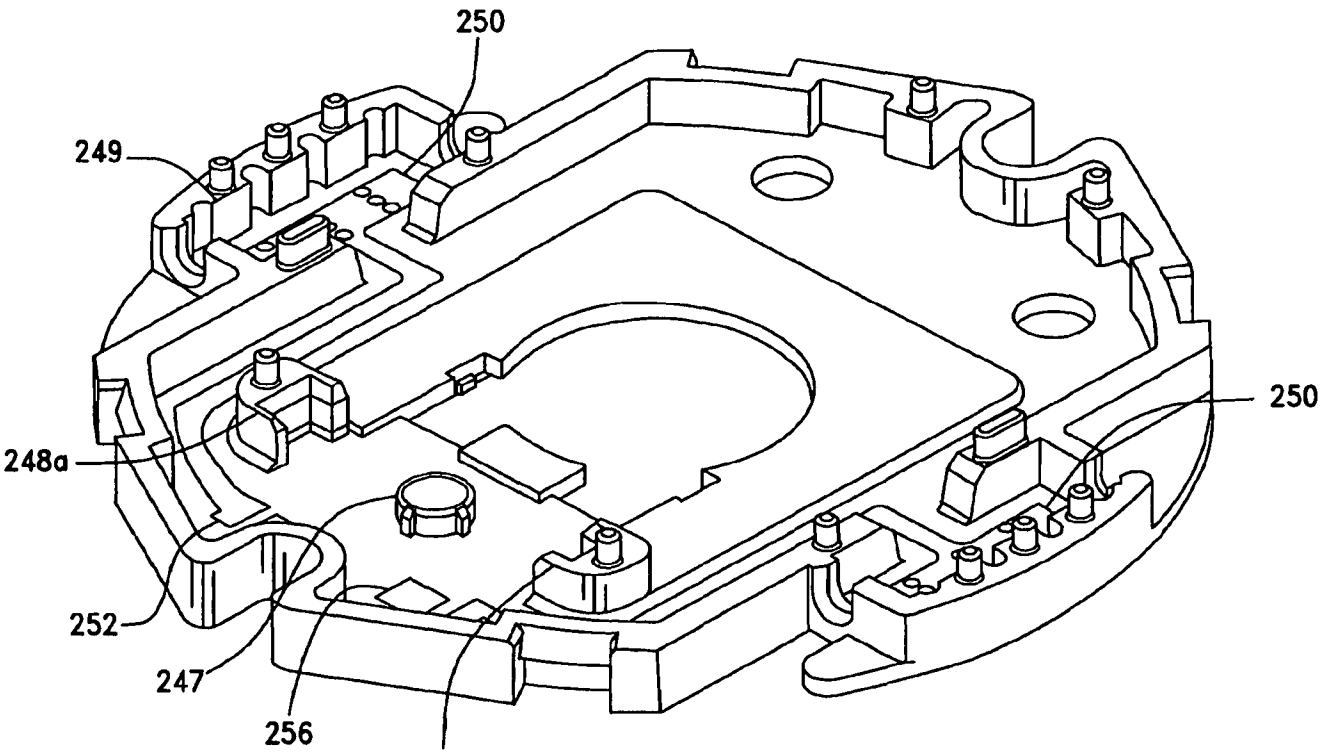
FIG. 22 illustrate a perspective simplified view of the frame depicted in FIG. 21.
Figure 23:
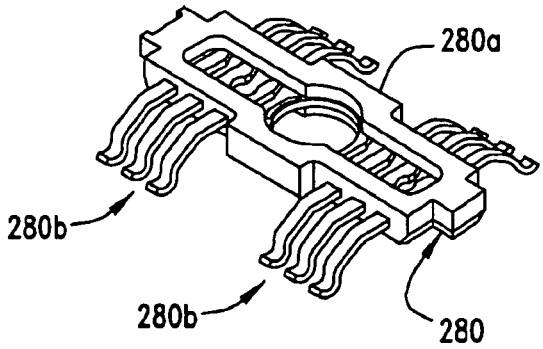
FIG. 23 illustrates a perspective view of an embodiment of a terminal brick.
Figure 24:
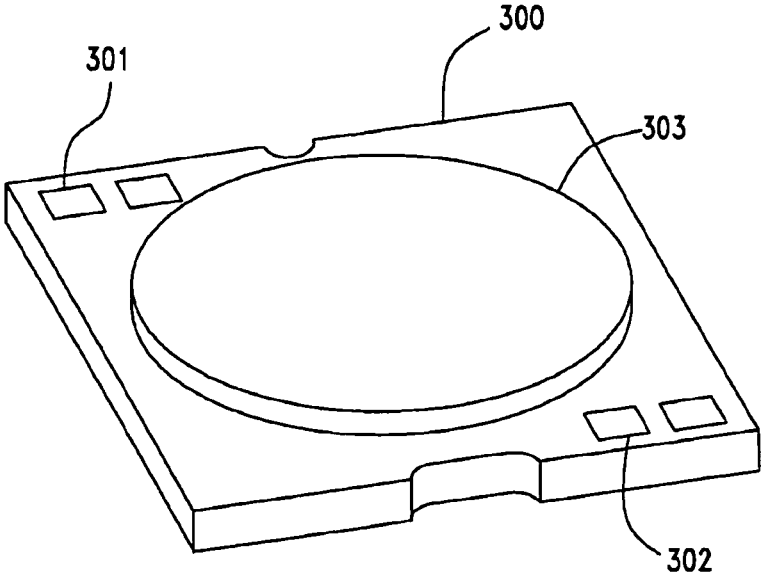
FIG. 24 illustrates a perspective view of an embodiment of an LED array.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity. Notably, the Figures illustrate a number of features that are shown together in certain illustrations but certain features could be removed as desired so as to provide an embodiment that included some of the depicted features while omitting other features. In addition, certain features of different embodiments could be combined together to provide an embodiment not depicted for purposes of brevity. Thus, unless otherwise noted, the depicted embodiments are not intended to be limiting.

FIGS. 1-9 illustrate features of an embodiment of a holder assembly 10 that includes a cover 20 that supports a reflector 15 and a heat spreader 90. The heater spreader 90 includes notches 91 that can receive fingers 22 and fastener openings 93 so that the heat spreader can be securely coupled to another surface. A frame 40 is positioned in an insulating plate 85 that is mounted on the heat spreader 90. The plate 85 includes a terminal notch 86, an aperture 88 sized to correspond to the frame 40 and alignment holes 87 that receive boss 43. An LED array 30 is positioned in an aperture of the insulating plate so that the LED array 30 has good thermal conductivity with the heat spreader 90 (preferably the system is configured so that there is less than a 3 C/W thermal resistance between the LED die and the heat spreader). In addition, a thermal pad 95 can be positioned on the heat spreader 90.

As can be appreciated, the frame 40 includes a wall 41 that extends around the LED array 30, thus forming an interior aperture 42. As depicted, the wall 41 supports terminals 52, 62 and the terminals 52, 62 are electrically connected to traces 54, 64, respectively. The traces 52, 62 are in turn respectively connected to terminals 50, 60 or terminals 50', 60' so as to provide, for example, an electrical connection between terminals 50, 60 and terminals 52, 62. It should be noted that for many applications, either terminals 50, 60 or terminals 50', 60' may be used without the other. For example, the terminals 50, 60 are intended to extend through an aperture 92 in the heat spreader 90 while terminals 50', 60' are intended to engage pads on plate 85 (not shown).

The terminal 52 has a contact 52*a* that engages pad 33 on the LED array 30 (the pad 33 in an embodiment may function as an anode or cathode for the LED array 30). The terminal 52 has a contact 62*a* that engages pad 34 on the LED array 30 (the pad 34 in an embodiment may function as an anode or cathode for the LED array 30). As can be, this allows power to be provided to the LED chip powered area 32 of the LED array 30. The LED array 30 can include notches 35*a*, 35*b* that can mate with mating portions of reflector 15. Securing holes 36*a*, 36*b* are aligned with fastener recess 42*a* so that the frame 40 can be secured to the heat spreader 90 using conventional fasteners (such as a screw).

As can be appreciated, curved edges 43*a*, 43*b* of the interior aperture 42 are provided. These can be helpful to allow more space for a reflector. As can be further appreciated, the contacts 52*a*, 62*a* are positioned in a terminal channel 45 in the wall 41 so that a terminal support 52*b* engages the wall 41 while the contact extends into the interior aperture 42.

FIGS. 10-18 illustrate features of another embodiment of a holder assembly 110. It should be noted that while an LED array is not depicted as being part of the holder assembly 110 in the provided illustrations, the inclusion of an LED array (such as LED array 300 with anode 301, cathode 203 and illumination portion 303) in a more complete assembly is contemplated and in certain cases would be highly beneficial. Omitting the LED array reduces the cost of the holder assembly and thus makes the holder assembly cheaper to import or export. However, as the LED array is needed to provide illumination and can be mounted to the holder assembly so that does not easily and accidentally become detached, in certain cases the further reduction in complexity (particularity if there is more than one LED array that can be mounted in the holder assembly) may make providing a complete assembly more desirable. For example, if a remote phosphor solution were to be used where a cover supported a remote phosphor puck then it might be beneficial to ensure the illumination portion (which in such a case would likely be blue pumps) would properly match the remote phosphor so that the desired light properties would be delivered.

The holder assembly 110 includes a cover 120 that supports a reflector 123 and supports a lens 125 (which may be integrated into the cover 110 or may be a separate element that can be mounted to the cover 110) mounted to a frame 140. If desired, the cover can include fastener recesses 127 with a fastener aperture 126 so that the holder assembly can readily be fastened to a support surface. The frame 140 includes an interior aperture 151 and a shoulder 152 is positioned in the interior aperture 151 so as to allow for secure engagement of an LED array. Furthermore, the shoulder 152 may support a projection 147 (which can snap into a corresponding aperture in a LED array) and may also include a second projection 146. In the event two projections are provided, the two projections 146, 147 can be configured so as to provide an orientation feature for a corresponding mating LED array.

To allow for engagement with a LED array, terminals 162 extend into the interior aperture 151. As depicted, a plate 170 is mounted on the frame 140 and forms, in cooperation with the frame 140, a first wire channel 171*a* and a second wire channel 171*b*. The plate 170 may be secured to the frame 140 with columns 168 that may be heat staked. The cover 120 can be secured to the frame 140 by having projections 121 engage retaining feature 166, which is a half collar in the depicted Figures. In an embodiment, two projections can engage two retaining features on opposite sides of the interior aperture 151.

As depicted, the frame 140 includes a tapered notch and the plate 170 also includes a tapered notch 173 that together form a guide to inserting a wire into the terminal 162. The terminal 162 is secured between pocket 172 and recess 174. To allow for bi-direction engagement of wires (e.g., to provide a wire trap that can engage wires in two directions), the terminal includes a base 162*b* from which a first wall 162*e* and a second wall 162*f* extend in a parallel direction. A first angled portion 162*d* extends from the first wall 162*e* and a second angled portion 162*c* extends from the second wall 162*f*. In operation, insertion of a wire (which preferably will be a single strand as it tends to be simpler to use with the depicted wire trap design) causes one of the wall to deflect. The wall exerts a force on the wire so that attempts to subsequently remove the wire are more difficult and at the same time the force causes the wall to maintain a reliable electrical connection with the wire. The base 162*b* further supports a contact 162*a* in a cantilevered manner. As can be appreciated, therefore, the contact 162*a* can be positioned entirely within the interior aperture.

The depicted array holder uses two terminals that are both configured to allow for insertion of a wire in two directions. As can be appreciated, however, one of the terminals could also be configured so that only one way insertion was possible (for example a plate and frame could be modified so that insertion of a wire was only possible from one direction or the terminal could be modified).

FIGS. 19-23 illustrate another embodiment of a holder assembly 200. As depicted, the holder assembly 200 includes a cover 220 with an integral reflector 225 and lens 223 mounted on a frame 240. The cover 220 includes retaining apertures 228 that engage posts 244 (which may be heat-staked) and also includes a first and second wire channel 272*a*, 272*b*. Thus, the depicted design allows for integration of separate components. It should be noted that a reflector and/or lens could also be formed separate from the cover 220 and mounted thereto.

The frame 240 also includes a pocket 249 that is configured to retain a terminal 262 in position. As above, the terminal is configured to allow for insertion of a wire in two directions. However, the terminal 262 omits a contact such as the contact 162*a* and instead is mounted on a terminal pad 250. A trace 251, 254 extends from the terminals 262 and extends to a pad 252, 255. A terminal brick 280 is mounted on the frame 240 and includes a terminal array 280*b* supported by a housing 280*a*. A first terminal 281 in the terminal array 280*b* engages the pad 252 (which is electrically connected to one of the terminals 262). Thus, current can be delivered from a mating wire to the LED array supported by the holder assemble 200.

As depicted, the terminal brick 280 supports six terminals 281, 282, 283, 284, 285, 286. Such a configuration is useful for engaging an LED array that includes three series of LED chips. For example, as can be appreciated, with the depicted position and configuration of the pads, each of the series of LED chips on a properly configured LED array can be placed in series (thus increasing the forward voltage of the LED array). The depicted configuration where contacts 282 and 283 both engage pad 253 while contacts 285, 286 both engage pad 256 is intended to have such an effect. Specifically, current could flow along trace 251, through terminal 281, then through terminal 282 and then terminal 283, next through terminal 286, then through terminal 285, then through terminal 284 and along trace 254.

Conversely, if the forward voltage was desired to be kept lower, then all three series of LED chips on a corresponding LED array could be electrically connected together in parallel so as to reduce the required forward voltage. Thus, the depicted configuration of a terminal brick and the use of traces to selectively engage terminals provided on the terminal brick allows for considerable flexibility in developing a driver for the chip. Naturally, the number of terminals provided in the terminal brick can be based on the number of series paths provided on an LED array. For example, if two paths of LED chips were provided, then four terminals would be sufficient to engage both paths and the paths could be powered in parallel or series (depending on the desired forward voltage and current of the LED array).

In any event, as can be appreciated, the terminals 281-286 have a contact that extends into the interior aperture 257 so as to engage correspond contacts on an LED array. It should be noted that while the number of terminals, as well as their position, provided in the terminal brick would vary depending on the LED array selected, the depicted terminal brick 280 could engage an LED array offered by CREE.

Most buildings tend to be wired so as to work with alternating current (AC) infrastructure that exists on the available power grid. However, LEDs chips are intended to work with direct current (DC) as they act as diodes and only allow current to flow in a single direction. One solution is to have a circuit that converts AC power to DC power. Such circuitry is well known and commonly used in modern electronics. However, use of such a system typically requires the installation of the conversion circuit on a fixture (or between the grid and the fixture) so as to provide DC power to the LED array. Otherwise, an LED array configured for use with AC power is required.

Figure 25:
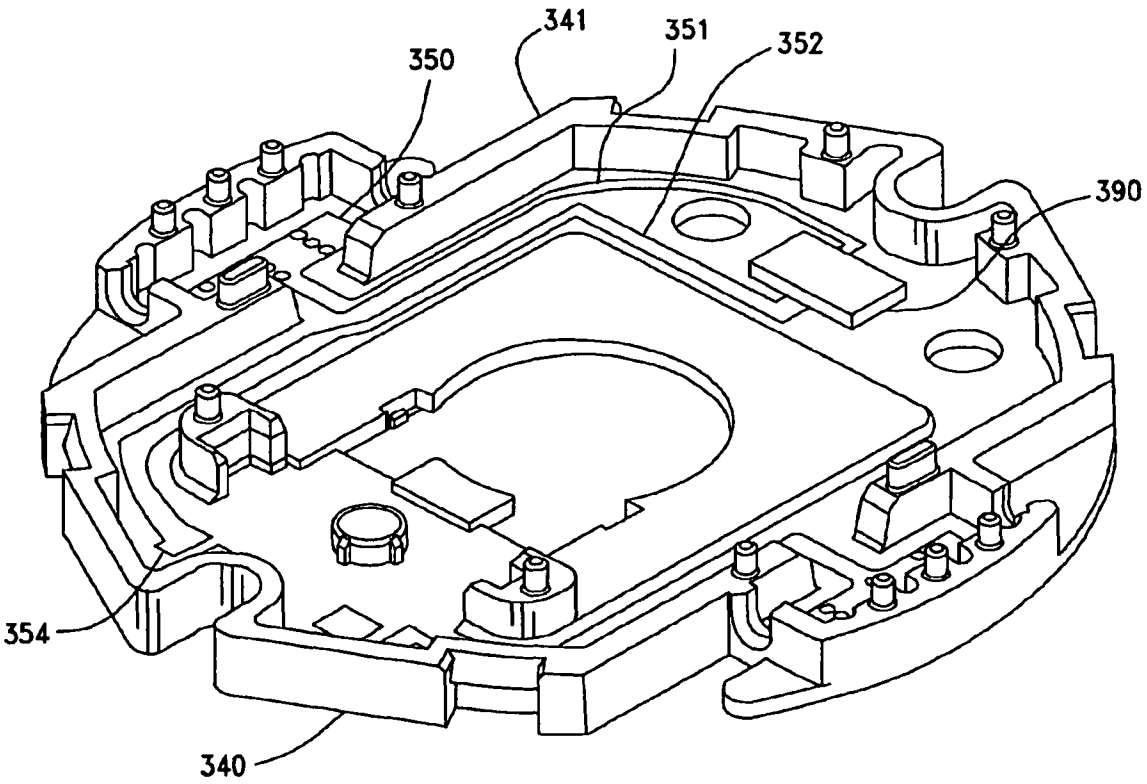
FIG. 25 illustrates a perspective view of another embodiment of a frame suitable for use with the holder assembly depicted in FIG. 19.

FIG. 25 illustrates an alternative solution to the requirement for an external conversion circuit. As can be appreciated, frame 340 is similar to frame 240 except that contact 350 (which could engage the terminal 262) is electrically connected to trace 351. Trace 351 extends to circuitry 390 and trace 352 extends away to a pad 354 that can engage a terminal provide by a terminal brick (as discussed above). The advantage of such a system is that entire conversion circuitry can be incorporated into the circuitry 390 (which is depicted as a single chip but also could be two or more components electrically connected together). In an embodiment, for example, a chip such as is provided by EXCLARA could provide conversion from 120 VAC to a desired DC voltage. Other possible designs include conversion of low voltage AC (e.g., 12 or 24 VAC) to a desired DC voltage. As can be appreciated, such circuitry can provide desirable dimmer performance with a variety of different dimmer protocols. Furthermore, with the use of higher quality components it is expected that such a circuit would have a life cycle of 50,000 hours or more (e.g., as great as the LED chips themselves), thus ensuring the resultant system provided good performance and value.

It should be noted that depending on the input voltage, larger or smaller traces may be used to provide the necessary current. As can be further appreciated, if there is a desire to use a higher input voltage (e.g., 120 VAC) then care should be taken to ensure the holder assembly can pass creepage and clearance requirements so that the system can meet the requirements of a standard body such as Underwriters Laboratories (UL). It has been determined, for example, that an insulative cover is well suited to provide the desired voltage isolation.

The disclosure provided herein describes features in terms of preferred and exemplary embodiments thereof. Numerous other embodiments, modifications and variations within the scope and spirit of the above disclosure will occur to persons of ordinary skill in the art from a review of this disclosure.

We claim:

1. A holder, comprising:

a frame including an interior aperture and a first pocket and a second pocket; and a first terminal and a second terminal respectively supported by the frame, at least one of the first and second terminals configured to receive and trap a wire inserted into the terminal in two different directions, further comprising a first channel plate and a second channel plate respectively aligned with the first and second pockets, the first and second channel plates mounted on the frame so as to restrain the first and second terminals in position and configured so as to cooperate with the frame and the first and second terminals so to provide a first and second wire-trap path.

2. The holder of claim 1, wherein the terminals each include a contact supported in a cantilevered fashion, the contact positioned in the interior aperture.

3. The holder of claim 1, wherein the frame includes a tapered notch to guide a wire into the terminal configured to trap a wire.

4. The holder of claim 1, wherein both the first and second terminals are configured to receive and trap a wire inserted into the terminal in two different directions.

5. The holder assembly of claim 1, wherein the first and second channel plates are heat-staked to the frame.

6. A holder, comprising:

a frame including an interior aperture and a first socket and a second socket; and a first terminal and a second terminal respectively supported by the frame, at least one of the first and second terminals configured to receive and trap a wire inserted into the terminal in two different directions, wherein a first and second trace are positioned on the frame, the first and second trace being electrically separated from each other and electrically connected to one of the first and second terminal.

7. The holder of claim 6, further including conversion circuitry supported by the frame, wherein the conversion circuitry includes an integrated chip configured to convert an input voltage to a desired DC voltage.

8. A holder assembly, comprising:

a cover;

a frame configured to support the cover, the frame including an interior aperture, a plurality of pockets and a plurality of retaining features and further including a first trace and second trace that are positioned on the frame, the first and second trace being electrically separated from each other; and a plurality of terminals mounted in the plurality of pockets, each of the plurality of terminals configured to receive and trap a wire inserted into the terminal in two directions, one of the plurality of terminals electrically connected to the first trace and another of the plurality of terminals connected to the second trace.

9. The holder assembly of claim 8, wherein the terminals each include a contact supported in a cantilevered fashion, the contact positioned in the interior aperture.

10. The holder assembly of claim 8, further comprising a terminal brick, the terminal brick support at least a first and second terminal, the first terminal in electrical communication with the first trace and the second terminal in electrical communication with the second trace.

11. The holder assembly of claim 10, wherein the first and second terminal of the terminal brick are included in an array of terminals and the array of terminals includes at least 4 terminals, each of the terminals in the array of terminals having a contact extending into the interior aperture.

12. The holder assembly of claim 10, further comprising a conversion circuitry configured to convert AC power to DC power.

13. The holder assembly of claim 12, wherein the conversion circuitry includes an integrated chip configured to convert 120 VAC to DC.

14. The holder assembly of claim 8, further comprising a plurality of channel plates aligned with the plurality of pockets, the plurality of channel plates mounted on the frame so as to restrain the plurality of terminals in position and configured so as to cooperate with the frame and the terminals so to provide a first and second wire-trap path.

15. The holder assembly of claim 14, wherein the cover includes a plurality of projections and the frame includes a plurality of retaining features, the cover and frame configured to be removably secured together.

16. The holder assembly of claim 14, wherein the plurality of channel plates are heat-staked to the frame.

17. The holder assembly of claim 8, wherein the cover and the frame are heat-staked together.

18. The holder assembly of claim 8, wherein the interior aperture includes a shoulder positioned along at least two areas, the shoulder configured, in operation, to engage a substrate of an LED array.

19. The holder assembly of claim 18, wherein the shoulder includes at least one projection configured, in operation, to engage the substrate so as to ensure the substrate is in a predetermined orientation.

20. The holder assembly of claim 8, wherein the frame and the cover are configured to be secured with a fastener that exerts pressure on the cover and the frame.

21. A holder, comprising:

a frame including an interior aperture, a first and second pocket and plurality of retaining features;

a first and second trace respectively extending from the first and second pocket;

a first and second terminal respectively mounted in the first and second socket, at least one of the first and second terminals configured to receive and trap a wire inserted into the at least one terminal in two different directions;

conversion circuitry electrically connected to the first trace, the circuitry configured to provide a desired DC output; and a cover mounted on the frame.

* * * * *